US007701108B2

(12) United States Patent
Yu et al.

(10) Patent No.: US 7,701,108 B2
(45) Date of Patent: Apr. 20, 2010

(54) COMBINATION-TYPE COLLECTOR RING UNIT

(75) Inventors: Meng-Chiu Yu, Taichung (TW); Su-Chen Liao, Taichung (TW)

(73) Assignee: Taiwan Long Hawn Enterprise Co., Taichung (TW)

( * ) Notice: Subject to any disclaimer, the term of this patent is extended or adjusted under 35 U.S.C. 154(b) by 288 days.

(21) Appl. No.: 11/960,124

(22) Filed: Dec. 19, 2007

(65) Prior Publication Data

US 2009/0091208 A1 Apr. 9, 2009

(51) Int. Cl.
*H01R 39/08* (2006.01)

(52) U.S. Cl. ..... 310/232; 439/23

(58) Field of Classification Search ..... 310/232; 439/20, 23–24, 28; 29/597
See application file for complete search history.

(56) References Cited

U.S. PATENT DOCUMENTS 1,493,859 A * 5/1924 Himes ..... 310/232
1,731,892 A * 10/1929 Ferris ..... 310/232
1,870,236 A * 8/1932 Chervenka ..... 310/232
2,696,570 A * 12/1954 Pandapas ..... 310/232
3,636,394 A * 1/1972 Forste et al. ..... 310/232
3,686,514 A * 8/1972 Dube et al. ..... 310/232
3,688,142 A * 8/1972 Forste et al. ..... 310/232
4,406,961 A * 9/1983 Pfluger et al. ..... 310/232

FOREIGN PATENT DOCUMENTS

JP 2003-45600 * 2/2003

* cited by examiner

*Primary Examiner*—Burton Mullins
(74) *Attorney, Agent, or Firm*—Browdy & Neimark, PLLC

(57) ABSTRACT

A collector ring unit includes a base, and a plurality of insulated spacer rings sleeved onto the base respectively and each having a ring body, a plurality of through holes through the ring body, and a notch formed on the ring body. A plurality of conductive slip rings are respectively sleeved onto the ring bodies of the insulated spacer rings and each have a socket. A plurality of conductive trips each have one end inserted into the socket of one conductive slip ring and received in the notch of one insulated spacer ring, and the other end passing through the through holes of the other insulated spacer rings and protruded out of the outermost insulated spacer ring. By means of addition or reduction of the numbers of the spacer rings, slip rings and conductive strips, the dimension of the collector ring unit of the invention can be changed.

10 Claims, 5 Drawing Sheets

COMBINATION-TYPE COLLECTOR RING UNIT

BACKGROUND OF THE INVENTION

1. Field of the Invention

The present invention relates generally to a collector ring unit which is used to be cooperated with carbon brushes for transmitting electrical power from a stationary component to a rotatable component, and more specifically to a combination-type collector ring unit that is easier to assemble than the conventional collector ring unit.

2. Description of the Related Art

A conventional collector ring unit mainly includes a metallic tube and a plurality of conductive slip rings spacedly sleeved on the metallic tube and electrically isolated from one another. The way to assemble the conventional collector ring unit is comprised of the steps of placing the metallic tube on which the electrically conductive slip rings have been spacedly sleeved in a mold and covering two ends of the metallic tube with plastics by means of injection molding for retaining the conductive slip rings on the metallic tube.

Because the components of the conventional collector ring unit have to be placed in the injection mold when they are assembled, the diameter and the thicknesses of the conventional collector ring unit are restricted by the dimension of the mold used, such that the dimension of the conventional collector ring unit is fixed subject to a specific dimension of the injection mold used. The more the dimensions of the convention collector units are required by the customers the more the dimensions of the injection molds are needed for the manufacturers, which is relatively cost inefficient. Therefore, it is a need to provide an improved collector ring unit that is easier to assemble than the conventional collector ring unit.

SUMMARY OF THE INVENTION

The present invention has been accomplished in view of the above-noted circumstances. It is one objective of the present invention to provide a collector ring unit, which can be assembled easily.

It is another objective of the present invention to provide a collector ring unit, whose dimension is changeable subject to the consumer's requirement by means of addition or reduction of components thereof when it is assembled.

To achieve these objectives of the present invention, the collector ring unit comprises a base, a plurality of insulated spacer rings, a plurality of conductive slip rings, the number of which is the same as that of the insulated spacer rings, and a plurality of conductive strips, the number of which is the same as that of the conductive slip rings. The insulated spacer rings are sleeved onto the base and each have a ring body, a spacer fringe protruding from an outer circumference of the ring body, a shaft hole at a center of the ring body, a plurality of through holes through the ring body and spaced around the shaft hole, and a notch formed on the ring body. The conductive slip rings are respectively sleeved onto an outer circumference of the ring body of one of the insulated spacer rings and each have a socket located in the notch of the associated insulated spacer ring. The conductive strips each have one end inserted into the socket of one of the conductive slip rings, and the other end passing through the through holes of the other insulated spacer rings and protruded out of the outermost insulated spacer ring. As a result, the dimension of the collector ring unit can be changed optionally to confirm customers' requirements by means of adjusting the numbers of the conductive slip rings and the insulated spacer rings to be assembled.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
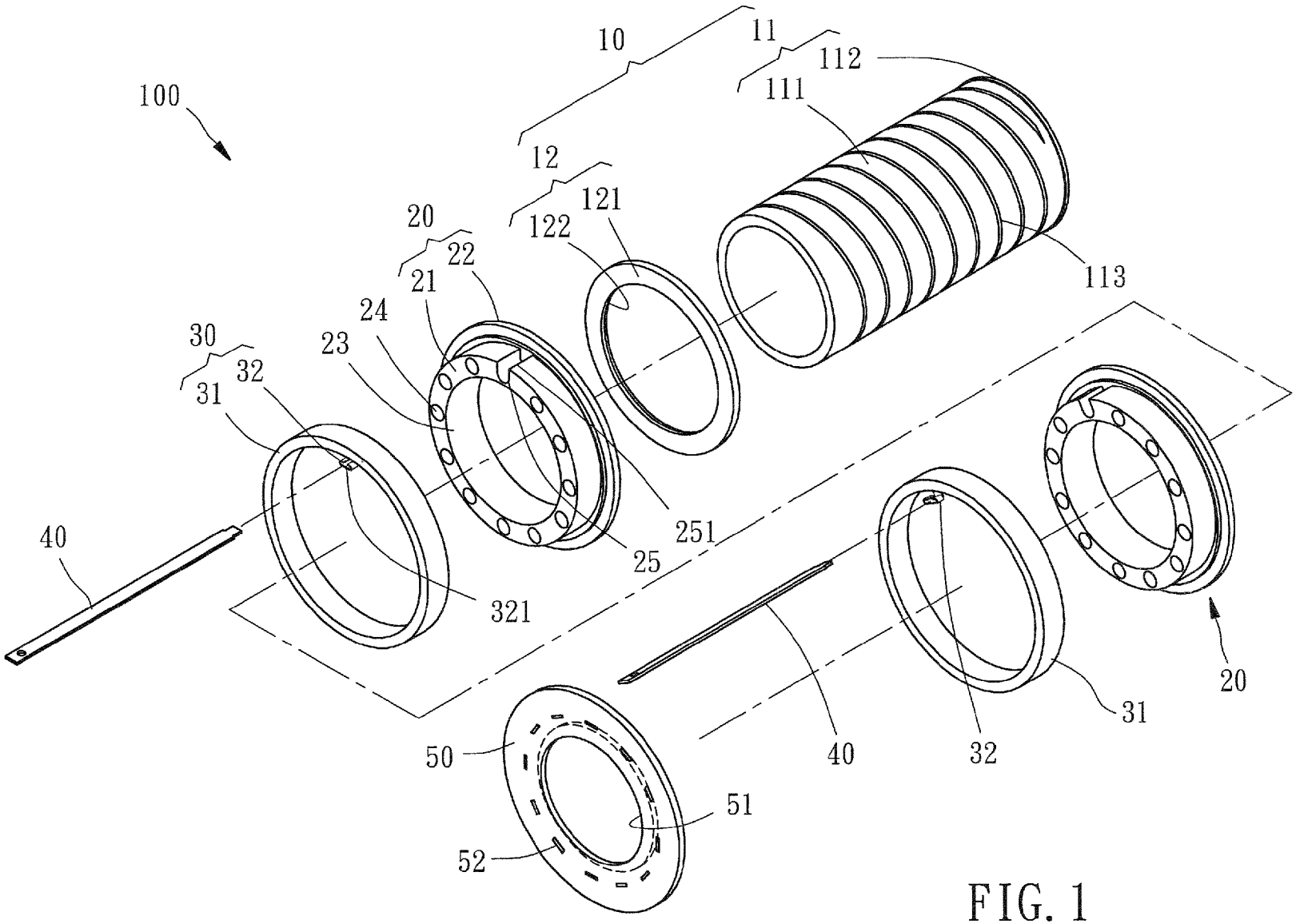
FIG. 1 is an exploded view of the collector ring unit according to a preferred embodiment of the present invention.
Figure 2:
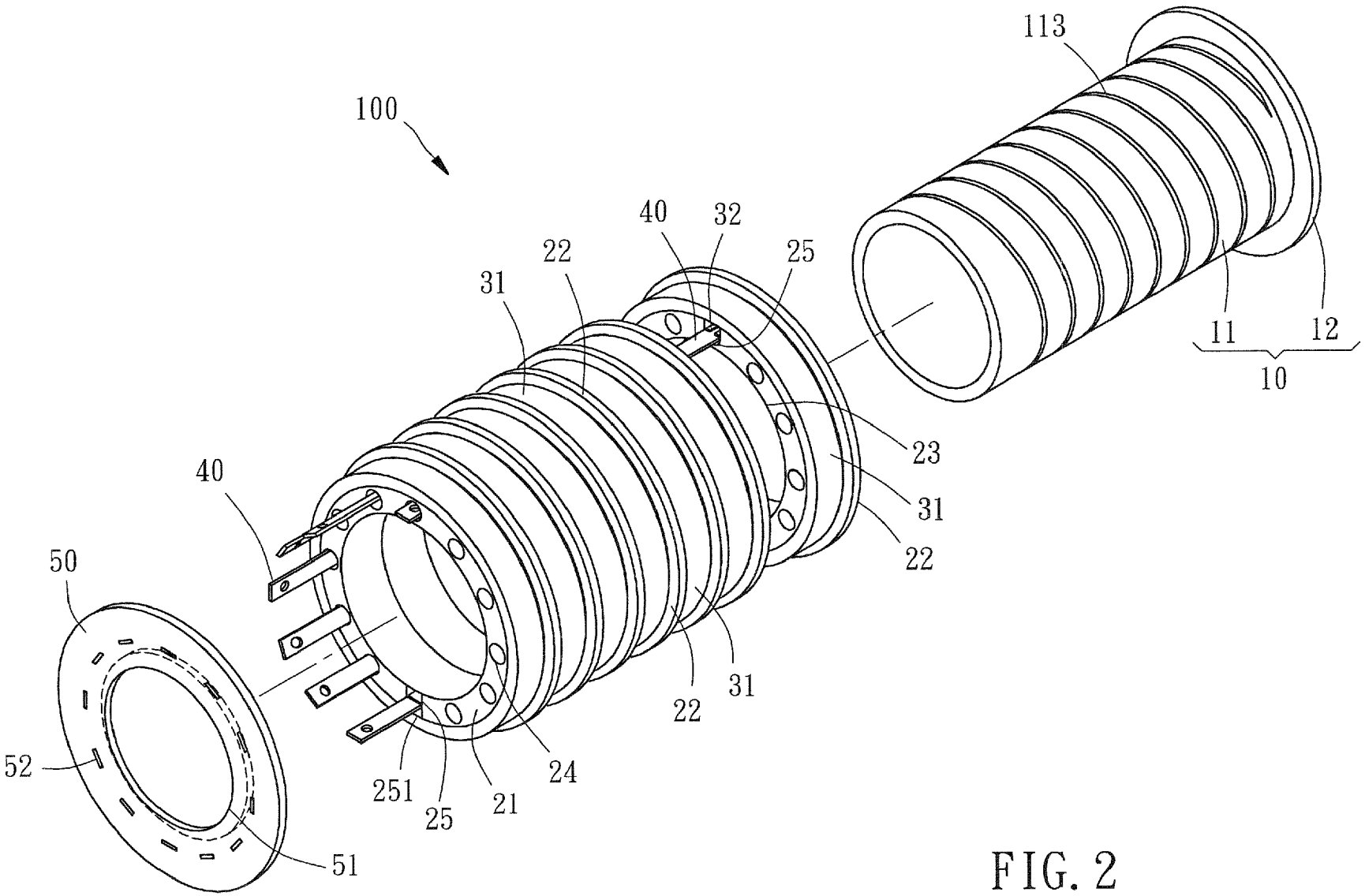
FIG. 2 is a partially exploded view of the collector ring unit according to the preferred embodiment of the present invention.
Figure 3:
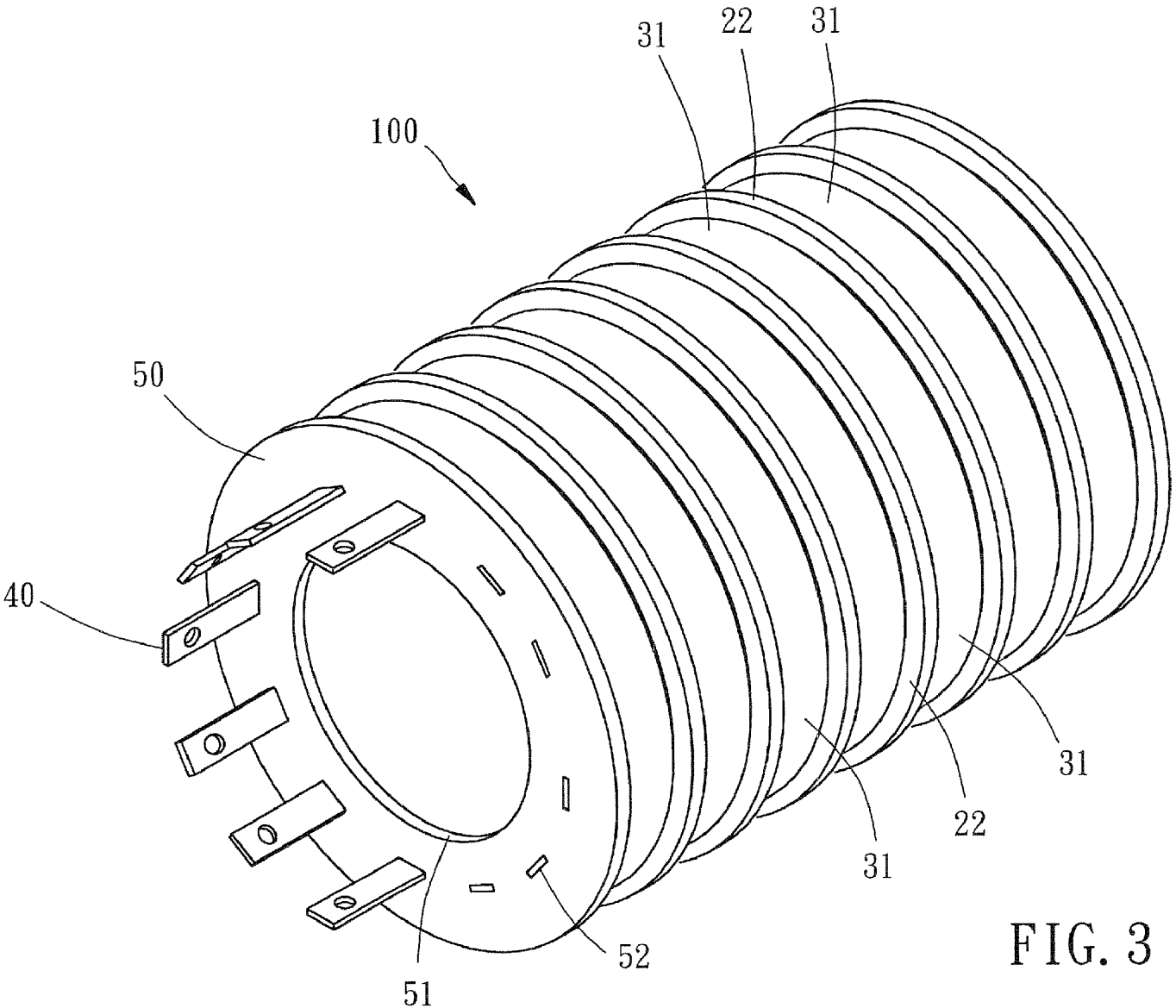
FIG. 3 is an assembled perspective view of the collector ring unit according to the preferred embodiment of the present invention.
Figure 4:
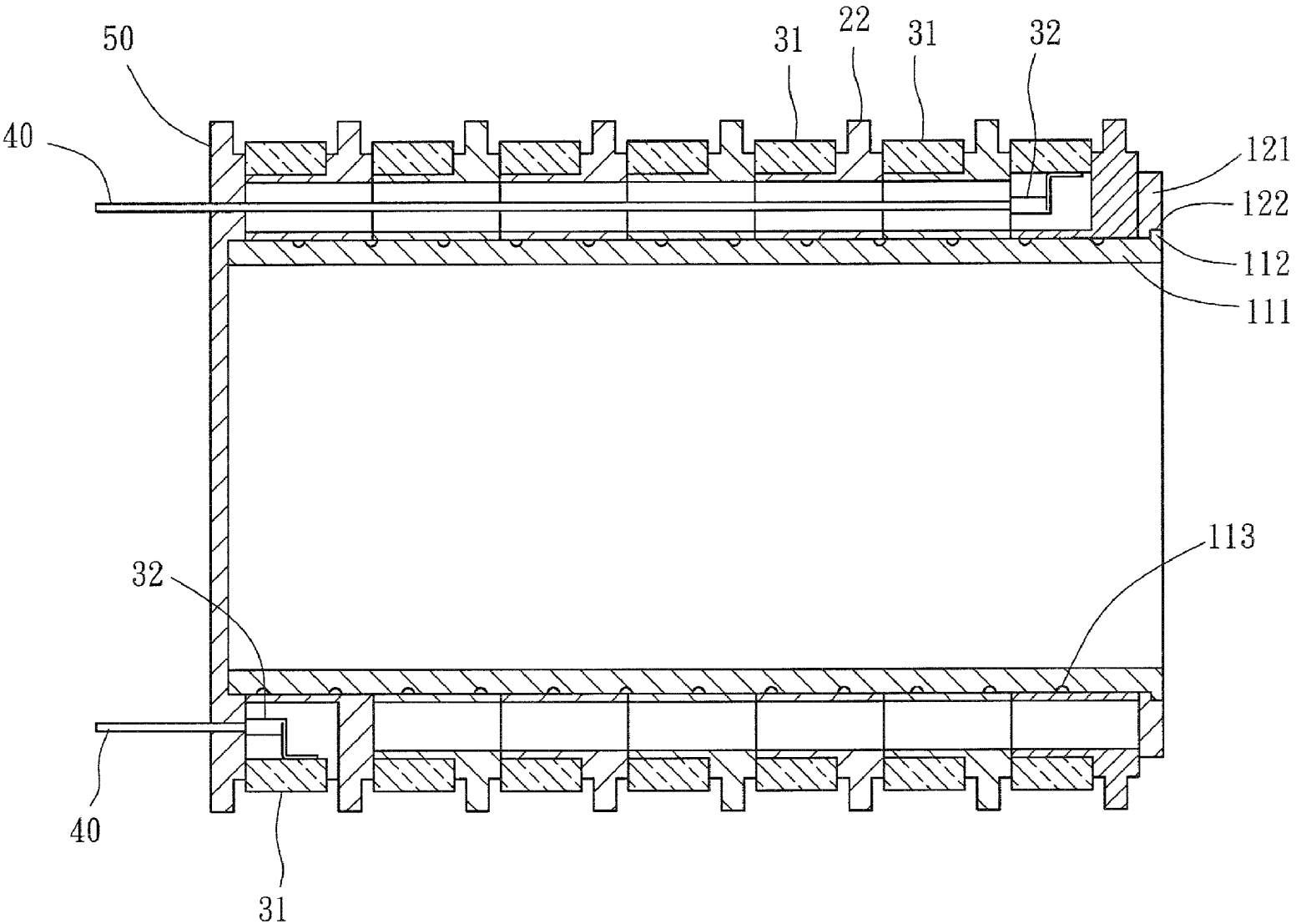
FIG. 4 is a lateral sectional view of the collector ring unit according to the preferred embodiment of the present invention.

Referring to FIGS. 1 to 4, a collector ring unit 100 in accordance with a preferred embodiment of the present invention comprises a base 10, a plurality of insulated spacer rings 20, a plurality of conductive slip rings 30, a plurality of conductive strips 40 and an insulated lid 50.

The base 10 includes a hollow metallic tube 11 having a body portion 111 provided at an outer circumference thereof with a groove 113 extending spirally along an axis direction of the tube 11, and a head portion 112 connected with one end of the body portion 111 and larger in external diameter than the body portion 111, and a limiting ring 12 provided with a ring body 121 and an insertion annular groove 122 recessed inwards in an inner circumference of the ring body 121 and having a diameter larger than the internal diameter of the ring body 121. The limiting ring 12 is sleeved onto the tube 11 in such a way that the head portion 112 of the tube 11 is inserted into the insertion annular groove 122 of the limiting ring 12 and an end surface of the limiting ring 12 is flush with an end surface of the head portion 112 of the tube 11.

Each insulated spacer ring 20 is made of electrically insulated materials, including a ring body 21, a spacer fringe 22 integrally protruding from an outer circumference of the ring body 21 and having an external diameter larger than that of the ring body 21, a shaft hole 23 through the center of ring body 21, a plurality of through holes 24 running axially through the ring body 21 and equiangularly spaced around the shaft hole 23, and a notch 25 formed on the ring body 21 and located between the two adjacent through holes 24 and provided with an opening 251 facing outwardly.

The conductive slip rings 30, the number of which is the same as that of the insulated spacer rings 20, each include a ring body 31 made of electrically conductive materials, and a receptacle 32 fixed on an inner circumference of the ring body 31 and provided with a socket 321 with an opening facing a direction parallel to the axis direction of the tube 11. The internal diameter of the ring body 31 is equal to or slightly greater than the external diameter of ring body 21 of the insulated spacer ring 20.

The conductive strips 40 are made of metal piece and each have different length. The number of the conductive strips 40 is the same as the number of the conductive slip rings 30.

The insulated lid 50 is made of electrically insulated materials and has a center hole 51 at a center thereof and a plurality of receiving holes 52 arranged spacedly around the center hole 51.

When the collector ring unit 100 is assembled, the ends of the conductive strips 40 are respectively inserted into the sockets 321 of the conductive slip rings 30 so as to fasten the conductive strips 40 to the conductive slip rings 30, and then the conductive slip rings 30 are respectively sleeved onto the outer circumferences of the ring bodies 21 of the insulated spacer rings 20 in such a way that each receptacle 32 of the conductive slip ring 30 is received in the notch 25 of the insulated spacer ring 20 through the opening 251, and then the insulated spacer rings 20 are sleeved onto the body portion 111 of the tube 11 of the base in turn according to the length of the conductive strips 40 inserted into the sockets 321 of the conductive slip rings 30, i.e. the insulated spacer ring 20, in which the longest conductive strip 40 is inserted, is sleeved first such that the first insulated spacer ring 20 is contacted with the limiting ring 12 through one side of the spacer fringe 22 and the insulated spacer ring 20, in which the shortest conductive strip 40 is inserted, is sleeved last. As a result, the ring bodies 31 of the conductive slip rings 30 are isolated by the insulated spacer rings 20 and the other ends of the conductive strips 40 pass through the through holes 24 of the insulated spacer rings 20 and protrude out of the last insulated spacer ring 20 and are flush with each other. Thereafter, the other ends of the conductive strips 40 can be inserted through the receiving holes 52 of the insulated lid 50 for enabling the insulated lid 50 to be covered on the last insulated spacer ring 20.

In order to enhance the stabilization of the insulated spacer rings 20 and the base 10, an adhesive (not shown, such as epoxy resin) can be spread on the groove 113 of the base 10 before the insulated spacer rings 20 are sleeved onto the base 10 such that the spiral groove 113 can be filled with the adhesive, thereby firmly fastening the insulated spacer rings 20 to the tube 11 of the base 10. Further, the adhesive can be injected into the through holes 24 of the insulated spacer ring 20 for enhancing the stabilization of the insulated spacer rings 20.

As indicative above, the collector ring unit 100 is assembled by sleeving the insulated spacer rings 20 onto the base 10 but not assembled in an injection mold. The number of the conductive slip rings 30 is changeable as long as the number of the conductive slip rings 30 can be matched with the number of the insulated spacer rings 20 and the length of the base 10 and the conductive strips 40.

Figure 5:
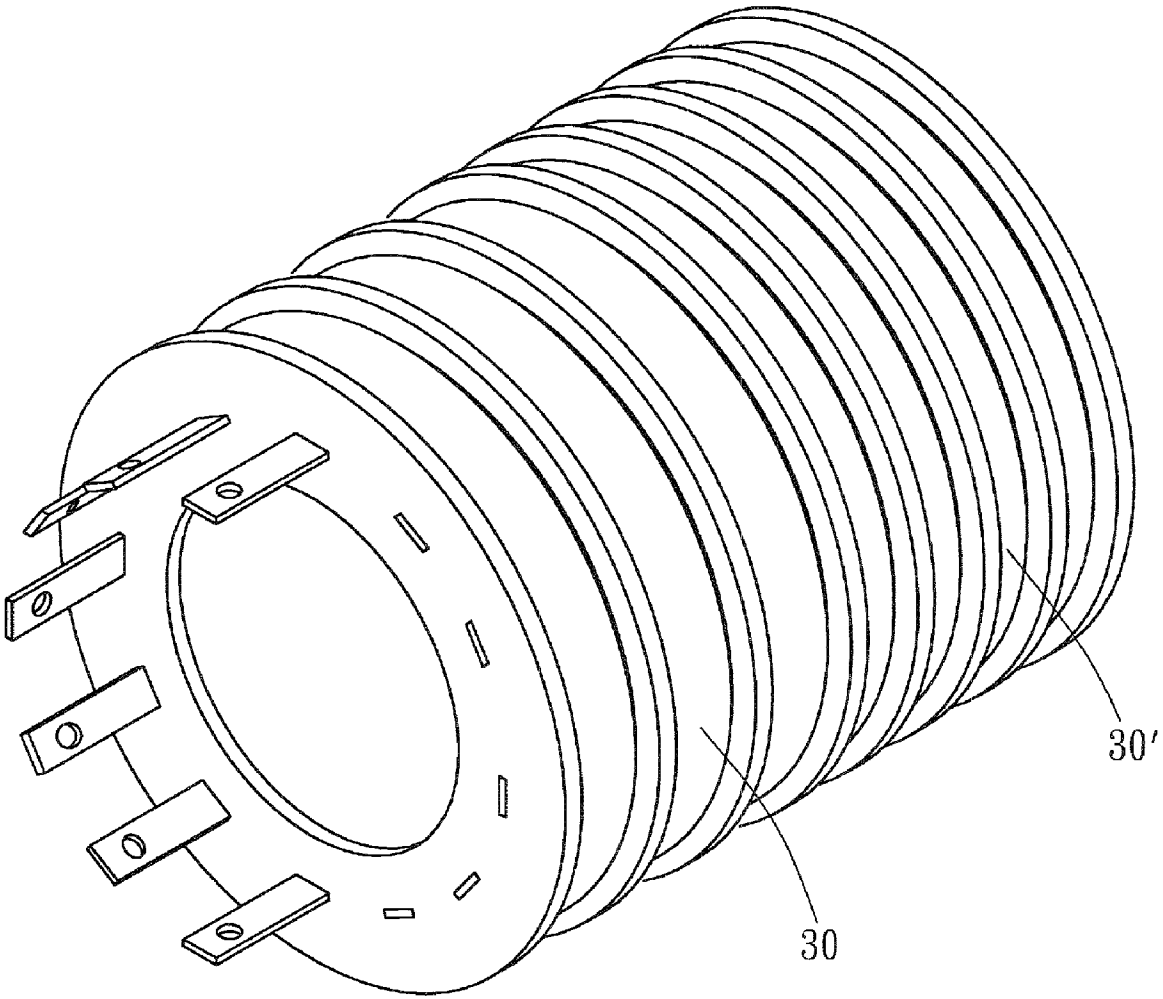
FIG. 5 is similar to FIG. 3 but showing an alternate form of the collector ring unit according to the preferred embodiment of the present invention.

In addition, the conductive slip rings 30 also can be changeable in thickness, as shown in FIG. 5. For example, the thick conductive slip rings 30 and the thin conductive slip rings 30' can be assembled together. Naturally, the external and internal diameter of the conductive slip rings 30 can be adjustable too. Thus, the collector ring unit 100 of the present invention can be easily assembled with a variety of dimensions to confirm different customers' requirements.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A collector ring unit comprising:

a base;

a plurality of insulated spacer rings sleeved onto the base, each insulated spacer ring having a ring body, a spacer fringe protruding from an outer circumference of the ring body, a shaft hole at a center of the ring body, a plurality of through holes through the ring body and spaced around the shaft hole, and a notch formed on the ring body;

a plurality of conductive slip rings, the number of which is the same as the number of the insulated spacer rings, each conductive ring being sleeved onto an outer circumference of the ring body of one of the insulated spacer rings and having a socket located in the notch of the associated insulated spacer ring; and a plurality of conductive strips, the number of which is the same as the number of the conductive slip rings, each conductive strip having one end inserted into the socket of one of the conductive slip rings and the other end passing through the through holes of the other insulated spacer rings and protruded out of the outermost insulated spacer ring.

2. The collector ring unit as claimed in claim 1, wherein the base has a tube, onto which the insulated spacer rings are sleeved, a limiting ring mounted on an outer circumference of the tube and stopped with the inner insulated spacer ring, and a groove formed on the outer circumference of the tube.

3. The collector ring unit as claimed in claim 2, wherein an adhesive is spread on the groove of the base and the through holes of the insulated spacer ring.

4. The collector ring unit as claimed in claim 2, wherein the groove of the base extends spirally.

5. The collector ring unit as claimed in claim 2, wherein the limiting ring has a ring body and an insertion annular groove recessed inwards in an inner circumference of the ring body, and the tube has a body portion and a head portion, which is inserted into the insertion annular groove of the limiting ring in such a way that an end surface of the limiting ring is flush with an end surface of the head portion of the tube.

6. The collector ring unit as claimed in claim 1, wherein the shaft hole of the insulated spacer ring axially passes through the center of the ring body of the insulated spacer ring such that the insulated spacer ring is sleeved onto the base by means of the shaft hole.

7. The collector ring unit as claimed in claim 1, wherein the notch of the insulated spacer ring has an opening facing outwardly for enabling the socket to be received in the notch through the opening.

8. The collector ring unit as claimed in claim 1, wherein the conductive slip ring has a ring body and a receptacle fixed on an inner circumference of the ring body and provided with said socket for insertion of the conductive strip.

9. The collector ring unit as claimed in claim 1, wherein the conductive strips have different length such that the ends of the conductive strips protruded out of the outermost insulated spacer ring are flush with each other.

10. The collector ring unit as claimed in claim 1, further comprising an insulated lid mounted on the outermost insulated spacer ring and having a center hole at a center thereof and a plurality of receiving holes arranged spacedly around the center hole for penetration of the conductive strips.

* * * * *